US009919519B2

(12) United States Patent
Ge

(10) Patent No.: US 9,919,519 B2
(45) Date of Patent: Mar. 20, 2018

(54) PRINTHEAD WITH PLURALITY OF FLUID SLOTS

(71) Applicant: Hewlett-Packard Development Company, L.P., Houston, TX (US)

(72) Inventor: Ning Ge, Palo Alto, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 15/104,909

(22) PCT Filed: Dec. 16, 2013

(86) PCT No.: PCT/US2013/075415
§ 371 (c)(1),
(2) Date: Jun. 15, 2016

(87) PCT Pub. No.: WO2015/094161
PCT Pub. Date: Jun. 25, 2015

(65) Prior Publication Data

US 2016/0347054 A1 Dec. 1, 2016

(51) Int. Cl.
*B41J 2/045* (2006.01)
*B41J 2/14* (2006.01)

(52) U.S. Cl.
CPC ..... *B41J 2/04563* (2013.01); *B41J 2/04581* (2013.01); *B41J 2/14153* (2013.01)

(58) Field of Classification Search
CPC . B41J 2/04563; B41J 2/04581; B41J 2/14153
See application file for complete search history.

(56) References Cited

U.S. PATENT DOCUMENTS 5,422,665 A * 6/1995 Stephany ..... B41J 2/04563 347/17
5,942,900 A 8/1999 Demeerleer et al.
6,382,773 B1 5/2002 Chang et al.
7,871,143 B2 1/2011 Ahne et al.
(Continued)

FOREIGN PATENT DOCUMENTS

EP 1310365 A2 5/2003
JP 2009 066861 A 4/2009
(Continued)

OTHER PUBLICATIONS

Mulay, S., "Thermal Simulation and Experimental Comparison of a Printhead", ASME 2007 5th International Conference on Nanochannels, Microchannels, and Minichannels, Puebla, Mexico, Jun. 18-20, 2007.
(Continued)

*Primary Examiner* — Alessandro Amari
*Assistant Examiner* — Roger W Pisha, II
(74) *Attorney, Agent, or Firm* — HP Inc. Patent Department

(57) ABSTRACT

A printhead including a fluid slot area in which a plurality of fluid slots are formed and a temperature sensing member, heating element or temperature sensing resistor including an edge portion and an inner portion. The edge portion extends along at least a part of an edge of the fluid slot area and the inner portion is connected to the edge portion and extends in-between two adjacent fluid slots.

15 Claims, 5 Drawing Sheets

(56) References Cited

U.S. PATENT DOCUMENTS

| | | | | |
|---|---|---|---|---|
| 2006/0103695 | A1* | 5/2006 | Young | B41J 2/14072 347/58 |
| 2008/0043063 | A1 | 2/2008 | Bergstedt et al. | |
| 2010/0123971 | A1 | 5/2010 | Kudo et al. | |
| 2010/0283819 | A1 | 11/2010 | Tamaru et al. | |
| 2013/0155142 | A1 | 6/2013 | Browning et al. | |

FOREIGN PATENT DOCUMENTS

| | | | |
|---|---|---|---|
| JP | 2009 208443 | A | 9/2009 |
| WO | WO-2008/002624 | | 1/2008 |

OTHER PUBLICATIONS

International Search Report and Written Opinion dated Aug. 13, 2014, PCT Patent Application No. PCT/US2013/075415 filed Dec. 16, 2013, European Patent Office.

* cited by examiner

PRINTHEAD WITH PLURALITY OF FLUID SLOTS

CLAIM FOR PRIORITY

The present application is a national stage filing under 35 U.S.C. § 371 of PCT application number PCT/US2013/075415, having an international filing date of Dec. 16, 2013, the disclosure of which is hereby incorporated by reference in its entirety.

BACKGROUND

Printheads may be used to eject ink or another fluid onto a receiving medium such as paper. Applications include, but are not limited to printers, graphic plotters, copiers and facsimile machines. Such apparatus use an ink jet printhead to shoot ink or another material onto a medium, such as paper, to form a desired image. More generally a print head is a precision dispensing device that precisely dispenses fluids such as ink, wax, polymers or other fluids. While printing to form an image on a receiving medium is one application, printheads are not limited to this and may be used for other purposes, such as manufacturing, digital titration, delivery of pharmaceuticals or 3D printing for instance.

Fluid may be delivered via a fluid slot of the print head to an ejection chamber beneath a nozzle. Fluid may be ejected from the ejection chamber by heating or by a piezo-electric pressure wave etc. Various factors affect the performance of the printhead, including the temperature of the fluid and surrounding printhead. Some printheads include a temperature sensing resistor which is used to detect a temperature of the printhead.

BRIEF DESCRIPTION OF THE DRAWINGS

Examples will now be described, by way of non-limiting example only, with reference to the accompanying drawings, in which.

DETAILED DESCRIPTION

A printhead may have a fluid slot area including a plurality of slots for delivering fluid to ejection chambers. The present disclosure proposes a temperature sensing member or heating element, which extends around at least a part of an edge of the fluid slot area and also between at least two adjacent fluid slots. As there is both an outer portion extending around an edge of the fluid slots and an inner portion extending between adjacent fluid slots it may take a temperature measurement which is representative of the printhead as a whole, or may heat both inner and outer regions of the printhead more uniformly. In one example a temperature sensing resistor acts as both a temperature sensor and a heating element.

The teachings herein may be applied to any size of printhead, but may be especially useful for larger printheads in which the time taken for temperature to equalize between different regions of the printhead may be longer.

Figure 1:
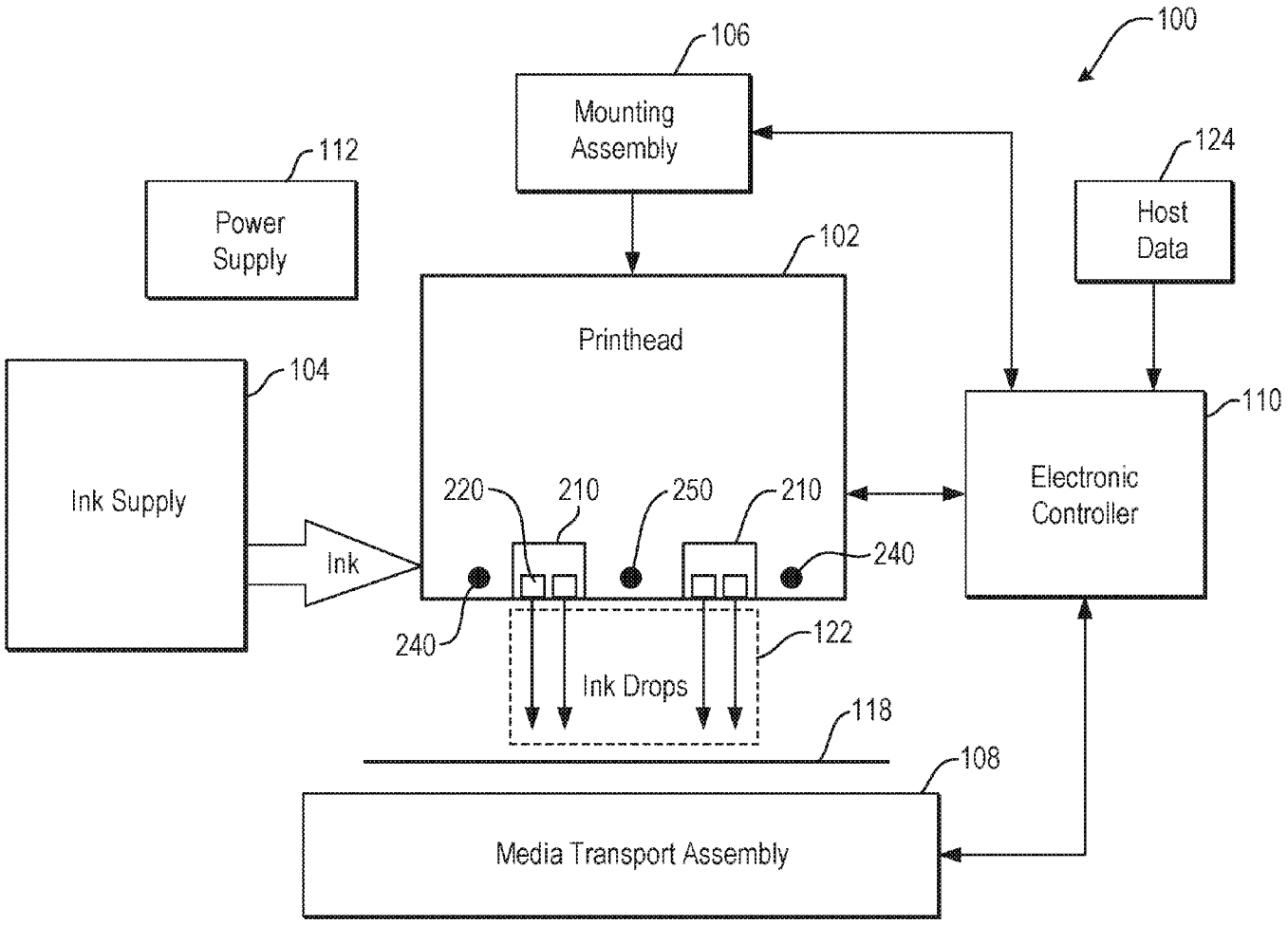
FIG. 1 shows a schematic example of a fluid ejection system.

FIG. 1 is a schematic diagram showing components of a fluid ejection system. For example the fluid ejection system may be a printer for ejecting ink onto paper or another printing medium. However, fluid ejection systems and printheads may be used for ejecting other types of liquid or fluid including but not limited to pharmaceutical fluids and 3D printing materials. For ease of reference, ink and ink slots will be referred to in the following description and examples, but it is to be understood that in some implementations other fluids may be substituted for ink and the teachings herein may be applied to devices for precision ejection of other types of fluid.

The system 100 includes an inkjet printhead 102, an ink supply 104, a mounting assembly 106, a media transport assembly 108, an electronic controller 110 and a power supply 112 to provide power to the various electrical components of the system.

The electronic controller 110 receives host data 124 from a host system, such as a computer, and controls the printhead 102 to eject ink drops to form characters, symbols, graphics or other patterns on the print medium based on the data.

In one example the printhead 102 is part of an integrated print cartridge including the ink supply 104. In another example the ink supply 104 is separate from the printhead and supplies ink to the printhead through an interface connection, such as a supply tube.

In the illustrated example the electronic controller 110 is separate from the printhead. The electronic controller 110 may be part of the main body of the printer and sends control signals to the printhead, e.g. via a bondpad or other terminal on the printhead. The electronic controller 110 may comprise an ASIC or processor, while the printhead 102 may have more simple electronic circuitry to carry out instructions from the electronic controller 110. Having the electronic controller 110 separate from the printhead makes it possible to keep the cost of the printhead down, as the printhead may be disposable. In other examples the electronic controller 110 may be integrated into the printhead.

The mounting assembly 106 supports the printhead and may enable it to be moved relative to printing medium 118 under control of electronic controller 110. The electronic controller also controls a media transport assembly 108, such as a paper feed mechanism, which moves the printing medium relative to the printhead.

The printhead includes a plurality of ink slots 210 in fluid communication with a plurality of ink ejection chambers 220 from which ink drops 122 are ejected through nozzles of the printhead onto a receiving medium 118. The printhead further comprises a Temperature Sensing Resistor (TSR) or other device which acts to measure the temperature of the printhead and/or heat the printhead. In other examples the heating and temperature measuring functions may be carried out by separate parts. The TSR includes an edge portion 240 extending around an outside of the ink slots 210 as well as an inner portion 250 extending between the ink slots. The edge portion and inner portion are connected together. The configuration of the TSR is only shown schematically in FIG. 1 and examples will now be discussed in more detail with reference to FIGS. 2 to 4.

Figure 2:
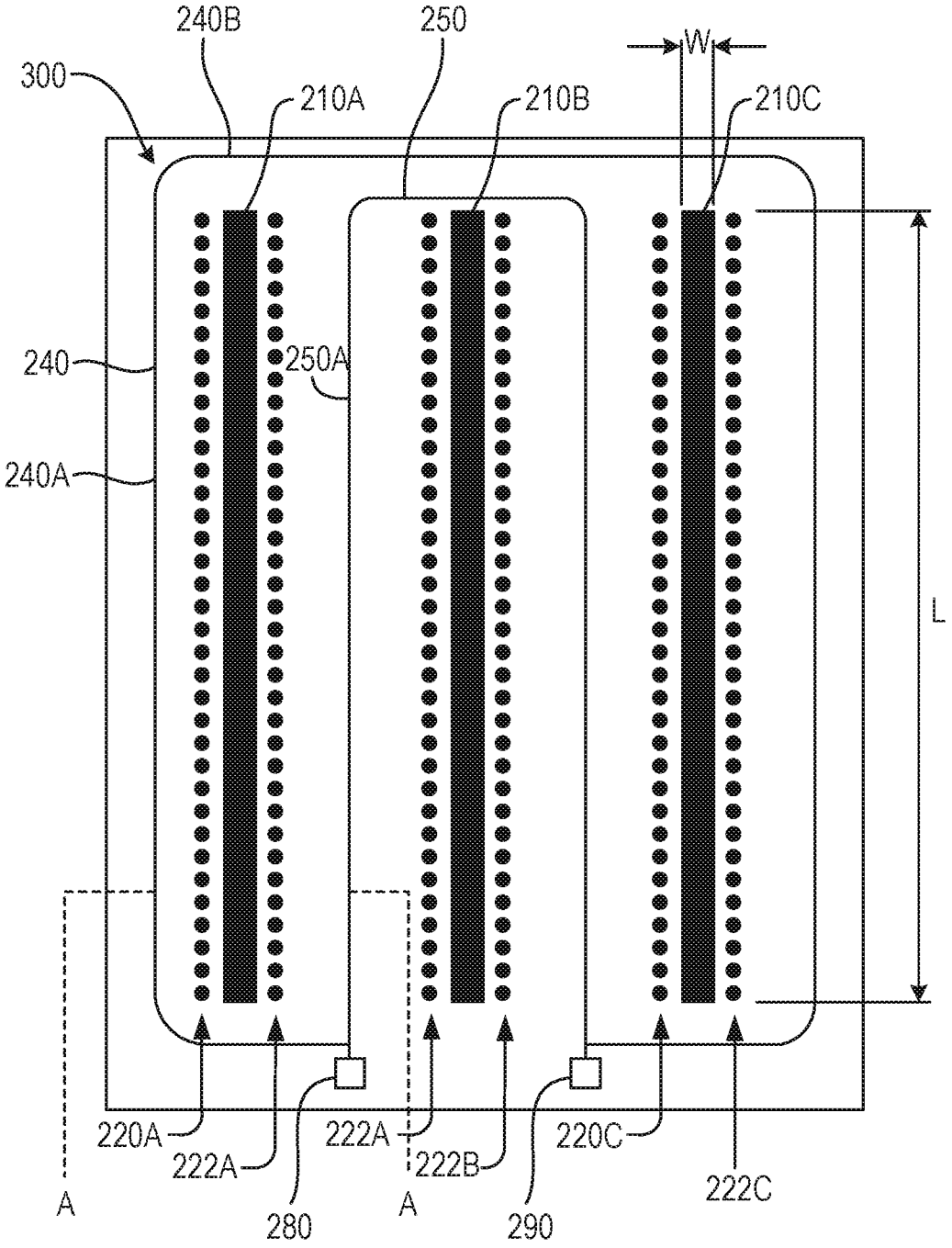
FIG. 2 shows a view from above of an example of a printhead having a plurality of fluid slots and a temperature sensing resistor, temperature sensing member or heating element according to the present disclosure.

FIG. 2 is a top down schematic view of the printhead 102. The printhead includes an ink slot area 300 in which a plurality of ink slots 210A, 210B and 210C are located. Each ink slot provides ink to a plurality of ink ejection chambers 220A, 222A, 220B, 222B, 220C and 222C which may be arranged in rows on one or both sides of the ink slot. The temperature of the ink in the ink slot and the ejection chambers affects the performance of the printhead. Therefore it is desirable to both determine the temperature of the ink and pre-heat the ink. For example the ink may be kept at or below a certain temperature, or within a certain temperature range while the printing system is active and before ink is further heated for ejection from the printhead.

As shown in FIG. 2 a temperature sensing resistor (TSR) extends around the ink slots. More specifically, the TSR includes an edge portion 240 and an inner portion 250. The edge portion 240 extends around at least a portion of the edge of the ink slot area 300. In this respect "edge portion" means a portion which extends along an edge of the ink slot area 300 and does not extend into the inner regions of the ink slot area in-between adjacent ink slots.

Meanwhile the inner portion 250 of the TSR extends in-between a pair of adjacent ink slots. By 'extends in-between' it is meant that the TSR extends inside the area which lies between two adjacent ink slots. In this way, as the TSR extends both around an edge of the ink slot area and into an inner region of the ink slot area, it is able to get a more representative temperature measurement than might be possible from a TSR which only extended around the edge regions, or a temperature sensor which was limited to a single discrete location. Similarly, due to having both an edge portion 240 and an inner portion 250, the TSR is able to heat the printhead more uniformly and efficiently.

Various configurations to achieve this effect are possible and variations will be discussed later with reference to FIGS. 4A to 4E. For now, it is noted that the TSR includes a first portion 240A which extends in a first direction along an edge of an ink slot, a second portion 240B which extends in a second direction past an end of an ink slot and a third portion 250A which extends in a third direction in-between two adjacent ink slots. Further the first portion 240A, second portion 240B and third portion 250A are connected and form part of the same circuit.

In the particular configuration shown in FIG. 2, the edge portion 240 forms a first loop and the inner portion 250 forms a second loop. The first and second loops are connected to each other and form a single circuit. The first and second loops are connected to the same input or output terminals. For example one end of the first loop and one end of the second loop are connected to the same bondpad 280, while the other ends of the first and second loops are connected to ground 290. A controller 110 can pass an electric current through the TSR via the bondpad 280 and ground 290 to heat the TSR or to detect a resistance of the TSR and thus determine the temperature of the TSR and surrounding printhead.

In FIG. 2 the first and second loops are both shown as being connected to the same ground. However, in other examples they could be connected to separate grounds. The TSR may be designed to have a particular resistance or range of resistances at room temperature—e.g. 60 to 70 Ohms. In that way different arrangements of TSR may be used with the same controller. In one example a predetermined current may be applied to the TSR and the voltage measured. The resistance and thus temperature may be determined from the measured voltage.

While FIG. 2 shows a TSR having an edge portion and inner portion, in other examples the TSR may be substituted with other devices. The TSR is an example of a device which is capable of acting as both a heating element and a temperature sensing member. In other examples the TSR may be used to sense temperature, but not to heat the printhead, and a separate heating device or heating devices may be used for heating the printhead. In still other examples the TSR may be substituted with a different type of temperature sensing member having the same configuration but not used to heat the printhead. In that case separate heaters may be provided. In other examples the TSR may be substituted with a heating element having the same shape, but which is not capable of sensing temperate, and separate temperature sensors may be provided in the printhead. However, using a device such as a TSR to both detect the temperature and provide heat to the printhead allows for a more compact design.

FIG. 2 is a schematic view and it should be noted that the ink slots 210, ink ejection chambers 220 and TSR 240, 250 may lie at different relative levels within the printhead structure, but they are all shown in FIG. 2 so that their relative positions can be appreciated. A cross section along the line A-A of FIG. 2 will now be discussed with reference to FIG. 3.

Figure 3:
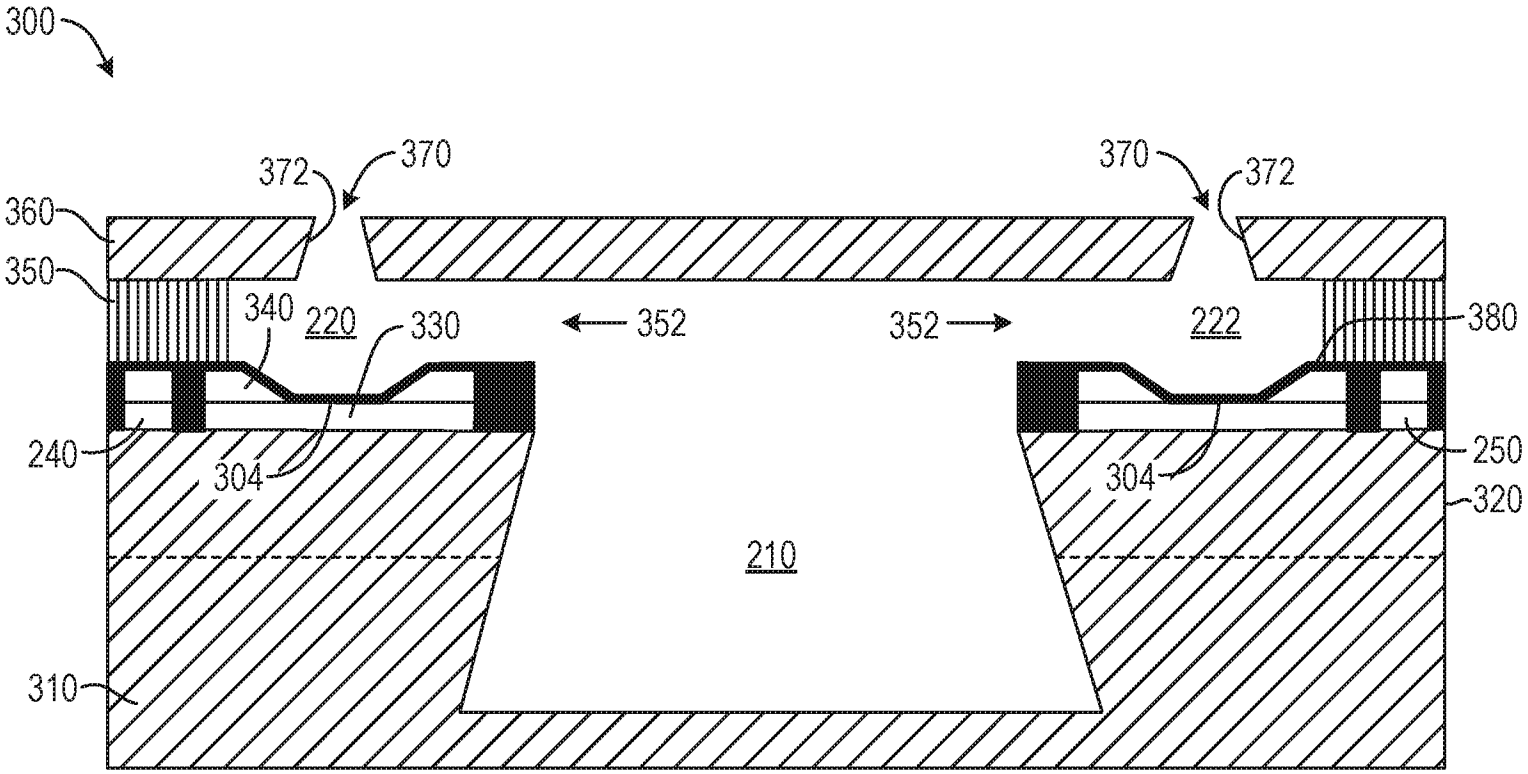
FIG. 3 shows a cross-sectional view along the line A-A of FIG. 2.

FIG. 3 shows a cross-sectional view along the line A-A of FIG. 2. In particular it shows an example construction of the printhead ink slots and TSR.

The printhead includes a die carrier 310 and a die 320 which are adhered together. The die 320 may for example be made of silicon or another suitable material. An ink slot 210 is an elongated slot formed in the die 320 and die carrier 310 that extends into the plane of FIG. 3. The ink slot 210 is in fluid communication with the ink supply (not shown) as well as with ink ejection chambers 220 and 222 which extend in rows on either side of the ink slot.

The ink ejection chambers 220, 222 are located above the die 320 and each forms part of a respective drop generator 370. The drop generators 370 include the ink ejection chamber 220 or 222, a firing element 304 directly beneath the ink ejection chamber and a nozzle 372 above the ink ejection chamber. The ink ejection chamber is defined by chamber walls including a barrier layer 350 at the side and a nozzle layer 360 in which the nozzle 372 is located above the chamber. A channel 352 allows passage of fluid from the ink slot 210 to the ink ejection chamber. The firing element 304 is for example a thermal resistor which may be heated to eject the ink through nozzle 372. The firing element 304 may for example be formed from a resistive layer 330 (e.g. TaAl, WSiN or TaSiN) and a conductive layer 340 (e.g. AlCu or another copper based material) on top of the resistive layer.

The TSR 240, 250 or other heating element or temperature sensing member is located near the ink slot 210 and may for example be formed on top of the die 320. In one example the TSR is at the same level and may be formed from the same materials as the firing element, e.g. from conductive layer 330 and resistive layer 340. The firing element 304 may be positioned between the TSR and the ink slot. The firing element and ink slot may be separated by an insulating layer such as passivation layer 380. The passivation layer 380 may also extend over the top of the firing element and/or the TSR to electrically insulate them from other components. When the passivation layer 380 extends as a thin layer over the firing element it helps to prevent passage of electric current through any fluid in the ink ejection chamber (as some printer inks are electrically conductive).

In another example (not shown) the firing element 304 and TSR 240, 250 may be provided on separate layers such that the firing element 304 and TSR 240, 250 are separated vertically as well as horizontally.

FIG. 3 shows the edge portion of the TSR 240 on an outer side of the ink slot 210 and the inner portion 250 of the TSR on an inner side of the ink slot.

The arrangement of FIG. 2 is one possible way to deploy a TSR, or temperature sensing member, or heating element, with both an outer portion 240 and an inner portion 250 so as to allow for uniform heating and/or more accurate temperature measurement of different regions of the printhead. However, it is possible to use other configurations and further examples will now be discussed with reference to FIGS. 4A to 4E.

Figure 4A:
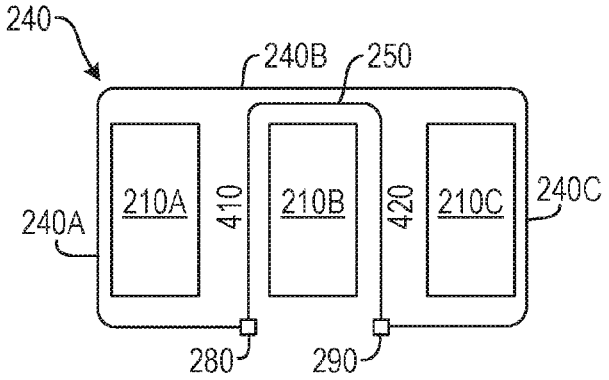
FIGS. 4A to 4E are schematic diagrams showing different arrangements according to the present disclosure.

FIG. 4A is a schematic diagram showing an example configuration of ink slots 210A, 210B, 210C and a TSR 240, 250 which is the same as in FIG. 2. The TSR comprises an edge portion 240 forming a first loop which surrounds an edge of the ink slot area on three sides, and an inner portion 250 which forms a second loop which extends in-between adjacent ink slots. More specifically, in FIG. 4A the edge portion 240 of the TSR includes a part 240A which extends along an edge of an ink slot, a part 240B which extends past an end of an ink slot and a part 240C which extends along an edge of an ink slot. As parts 240A, 240B and 240C extend around an edge of the ink slot area they do not extend in-between adjacent inks slots. Meanwhile, a first inner region 410 is defined between ink slots 210A and 210B and a second inner region 420 is defined between ink slots 210B and 210C. The inner portion 250 of the TSR extends into both the first inner region 410 and the second inner region 420.

Figure 4B:
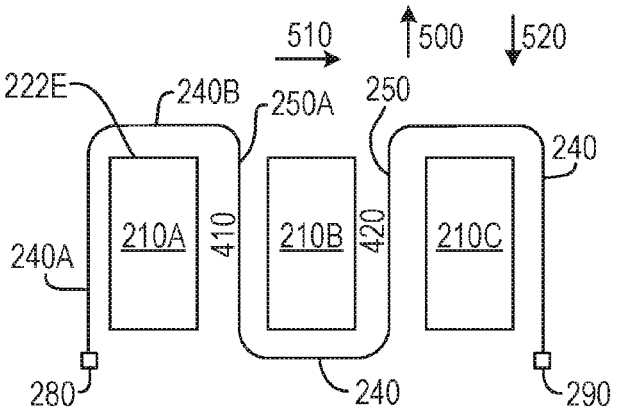

FIG. 4B shows another example in which the TSR has a serpentine shape. By "serpentine" it is meant that the TSR changes direction with twists and turns going back and forth between the edge and inner regions of the ink slot area. It can be seen in FIG. 4B that the TSR is a resistive element extending from bond pad 280 to ground 290 along a path which includes both edges of the ink slot area an inner regions of the ink slot area in-between adjacent ink slots. The TSR includes a plurality of edge portions 240 which extend around an edge of the ink slot area as well as a plurality of inner portions 250 which extend in between adjacent ink slots. The TSR includes a first portion 240A which extends in a first direction 500 along an edge of an ink slot, a second portion 240B which extends in a second direction 510 past an end 222E of an ink slot, and a third portion 250A which extends in a third direction 520 through an inner region 410 in-between two adjacent ink slots. The first, second and third portions 240A, 240B and 250A are connected together and in this example form a single continuous element. The TSR in FIG. 4B may be said to fully surround the ink slot area on two sides (left and right of FIG. 4B) and partially surround the ink slot area on a third side (top of FIG. 4B). It may be said to partially surround the third side as two thirds of that side are surrounded by the TSR with just one out of three ink slot ends not being surrounded.

Figure 4C:
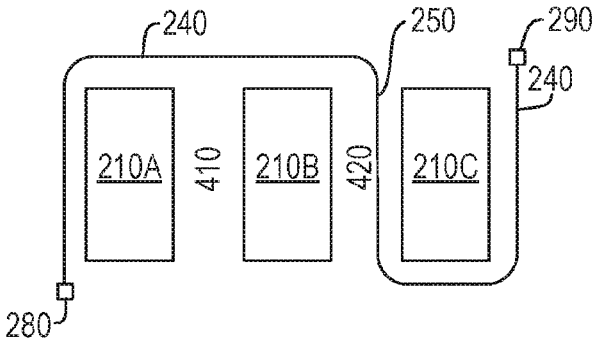

FIG. 4C is another example configuration of a serpentine shape similar to FIG. 4B, but in which the TSR extends into the second inner region 420, but not the first inner region 410.

Figure 4D:
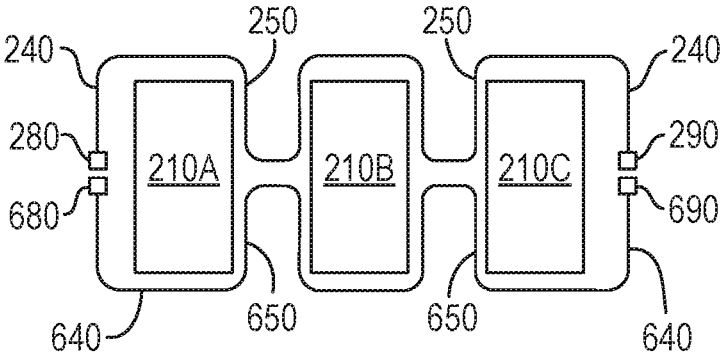

FIG. 4D shows another example in which there are two TSRs. Each TSR has a serpentine shape. The first TSR includes edge portions 240 which extend around edges of the ink slot area and inner portions 250 which extend into inner regions in-between adjacent ink slots. The first TSR surrounds the ink slot area on one side (the top of FIG. 4D), but does not surround the other two sides as it only extends halfway down the sides. The second TSR is similar to the first TSR and includes edge portions 640 as well as inner portions 650. It extends between a second bondpad 680 separate from the first bondpad and a ground 690 which may be the same as ground 290 or may be a different ground.

The examples above show three ink slots, which is a common configuration. For instance, a color printhead may be designed to have separate slots for three different colors of ink. However, in other cases the ink color may be the same in each slot. Indeed the teachings of the present disclosure and various examples discussed above may be modified and extended to printheads having four or more ink slots as well to devices having just two ink slots.

Figure 4E:
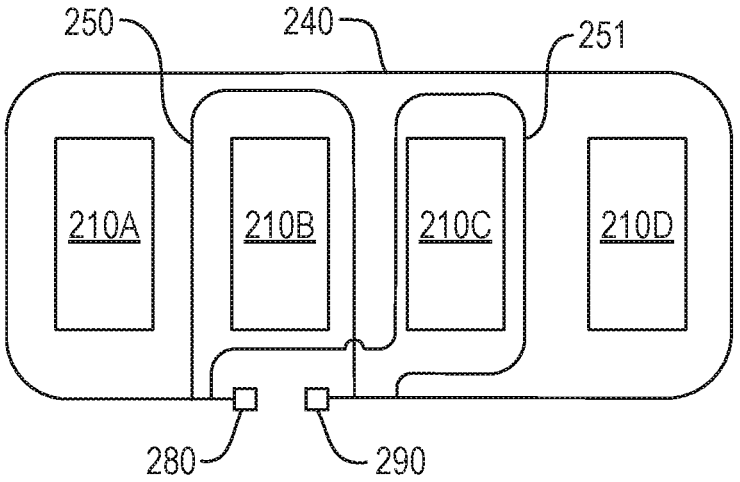

FIG. 4E is another example which is similar to FIG. 4A, but in which there are four ink slots 210A-210D, rather than three ink slots. In this example the TSR has one outer loop forming the outer portion 240 and two inner loops 250 and 251 which for respective inner portions. All three loops are connected to the same input terminal. In other examples there may only be one inner loop such and the inner portion of the TSR may only enter some of the inner regions between ink slots. In another example the inner loop may have a serpentine shape and enter several inner regions between different pairs of adjacent ink slots. Further, the designs shown in FIGS. 4A to 4D may all be modified for use with printheads or printhead dies having four or more slots.

As mentioned in FIG. 2, each ink slot as a length L and a width W which is much less than the length. In general the edge portion 240 of the TSR should have a length equal to or greater than a third of the length L of an ink slot in order that a representative temperature can be measured and/or to facilitate more uniform and efficient heating. In some examples, the length of the edge portion may be greater than or equal to the length of an ink slot or longer, for instance greater than or equal to the length of two ink slots. In FIG. 4D the combined length of edge portions 240 are approximately equal to a length of an ink slot, while in the examples of FIGS. 4A to 4C and 4E the edge portion 240 or combined edge portions have total length which is significantly greater than the length of an ink slot and may in some cases be greater than double the length of an ink slot.

While the discussion of FIGS. 4A to 4E above refers to a TSR, in other examples the TSR could be substituted with a different type of heating and temperature sensing device, or with heating element which does not sense temperature or a temperature sensing member which does not supply heat to the printhead but having the same general shape and configuration. If the TSR is substituted by a heating element then a separate temperature measuring devices or devices may be provided. If the TSR is substituted by a temperature sensing member, then a separate heater or heaters may be provided in the printhead.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings), may be replaced by alternative features serving the same, equivalent or similar purpose, unless expressly stated otherwise. Thus, unless expressly stated otherwise, each feature disclosed is one example only of a generic series of equivalent or similar features.

What is claimed is:

1. A printhead die comprising:

a fluid slot area in which a plurality of fluid slots are formed; and a temperature sensing resistor; the temperature sensing resistor including an outer edge portion forming a first loop and an inner portion forming a second loop, wherein the outer edge portion is separate from the inner portion;

wherein the first loop extends outside of and along an edge of the fluid slot area and the second loop extends in-between two adjacent fluid slots;

wherein a first end of the first loop connects directly to a bond pad and a second end of the first loop connects directly to a ground and wherein a first end of the second loop connects directly to the same bond pad as the first loop and a second end of the second loop connects directly to the ground.

2. The printhead die of claim 1, wherein the outer edge portion surrounds the fluid slot area on three sides.

3. The printhead die of claim 1, wherein the temperature sensing resistor forms part of a circuit to sense a temperature of the printhead die and to deliver heat to the printhead die.

4. The printhead die of claim 1, wherein the plurality of fluid slots includes a first outer slot, a second outer slot, and a central slot positioned between the first outer slot and the second outer slot, and wherein the second loop extends around the central slot.

5. The printhead die of claim 1, further comprising:

a firing element positioned adjacent to a section of the temperature sensing resistor.

6. The printhead die of claim 5, wherein the firing element is positioned between a fluid slot of the plurality of slots and the section of the temperature sensing resistor.

7. The printhead die of claim 6, further comprising a passivation layer extending between the firing element and the fluid slot and between the firing element and the temperature sensing resistor.

8. The printhead die of claim 7, wherein the passivation layer extends above the firing element and the temperature sensing resistor.

9. A printhead comprising:

a plurality of fluid slots;

a temperature sensing member including an outer edge portion forming a first loop and an inner portion forming a second loop, wherein the first loop extends outside of plurality of fluid slots and the second loop extends between two adjacent fluid slots of the plurality of fluid slots, and wherein the outer edge portion does not overlap the inner portion;

a first bond pad; and a second bond pad, wherein a first end of the first loop connects directly to the first bond pad and a second end of the first loop connects directly to the second bond pad and wherein a first end of the second loop connects directly to the first bond pad and a second end of the second loop connects directly to the second bond pad.

10. The printhead of claim 9, wherein the temperature sensing member forms part of a circuit to sense a temperature of the printhead and to deliver heat to the printhead.

11. The printhead of claim 9, wherein the plurality of fluid slots includes a first outer slot, a second outer slot, and a central slot positioned between the first outer slot and the second outer slot, and wherein the second loop extends around the central slot.

12. The printhead of claim 9, further comprising:

a firing element positioned adjacent to a section of the temperature sensing resistor.

13. The printhead of claim 12, wherein the firing element is positioned between a fluid slot of the plurality of slots and the section of the temperature sensing resistor.

14. The printhead of claim 13, further comprising:

a passivation layer extending between the firing element and the fluid slot and between the firing element and the temperature sensing resistor.

15. The printhead of claim 14, wherein the passivation layer extends above the firing element and the temperature sensing resistor.

* * * * *